US005367752A

United States Patent [19]

Petty

[11] Patent Number: 5,367,752

[45] Date of Patent: Nov. 29, 1994

[54] EXPANDABLE WRAPPING RIBBON

[76] Inventor: Roy L. Petty, 148 Rio Vista Pl., Santa Fe, N. Mex. 87501

[21] Appl. No.: 164,904

[22] Filed: Dec. 10, 1993

[51] Int. Cl.[5] ..... B65D 63/00

[52] U.S. Cl. ..... 24/301; 24/17 B

[58] Field of Search ..... 24/17 R, 17 B, 17 AP, 24/300, 301, 163 K; 428/4, 5, 52; 63/5.1

[56] References Cited

U.S. PATENT DOCUMENTS

| | | | |
|---|---|---|---|
| 219,609 | 9/1879 | Weaver . | |
| 381,879 | 4/1888 | Howard . | |
| 382,287 | 5/1888 | Brandenburg | 24/301 X |
| 683,476 | 10/1901 | Meacham, Jr. . | |
| 738,462 | 9/1903 | Lincoln | 24/17 B |
| 828,512 | 8/1906 | Sanders . | |
| 1,526,702 | 2/1925 | Ford | 63/5.1 X |
| 1,559,587 | 11/1925 | Pilcher et al. . | |
| 1,696,220 | 12/1928 | Townsend | 24/301 |
| 2,516,292 | 7/1950 | Bennett . | |
| 2,654,132 | 10/1953 | Norcross | 24/301 |
| 4,111,132 | 9/1978 | Plut | 24/301 X |
| 4,715,839 | 12/1987 | Ford et al. | 24/163 K X |
| 5,279,019 | 1/1994 | Knickle | 24/17 B |

*Primary Examiner*—James R. Brittain
*Attorney, Agent, or Firm*—Rod D. Baker

[57] ABSTRACT

An expandable ribbon apparatus is provided for simply and quickly wrapping packages or securing bundles. The elastic element of the apparatus is hidden and protected by a sheath. Various modes of attaching decorative and identifying items to the apparatus are disclosed. The apparatus is intended to be ornamental as well as functional.

18 Claims, 4 Drawing Sheets

EXPANDABLE WRAPPING RIBBON

BACKGROUND OF THE INVENTION

1. Field of the Invention (Technical Field)

The invention relates to an expandable ribbon for securing a cover or wrapper around a package and for attaching items to the package, or for bundling objects together.

2, Background Art

Mankind has, of course, been tying things into bundles since time immemorial. Passing a rope or string around a collection of items in order to bundle them together is an activity so basic as to not warrant further discussion. Similarly, the practice of wrapping bundles and packages with sheets of cloth or paper prior to securing the package with rope, string, or ribbon has been commonplace for centuries.

Nevertheless, the fundamental need to cover and/or secure a bundle or package is so commonplace and frequently encountered that efforts have always been ongoing to improve the process and provide better means for performing it.

For example, U.S. Pat. No. 2,516,292 to Bennett, entitled *Consumer Goods Segregator,* discloses an adjustable ring to be disposed about bundles of perishable food products.

U.S. Pat. No. 828,512 to Sanders, entitled *Package Tie,* shows a hooked strap with elastic members. No elements are shown which serve to protect and beautify the strap, or which provide secure attachment of collateral items to the strap.

U.S. Pat. No. 683,476 to Meachem, entitled *Package Tie,* discloses an assembly of tapes and flexible metal clips for bundling together a collection of objects.

U.S. Pat. No. 381,879 to Howard, entitled *Elastic Band,* discloses a band apparatus for securing together a bundle of items.

U.S. Pat. No. 219,609 to Weaver, entitled *Fastening Strip or Clasp,* discloses a loop-and-tongue strap device for bundling items.

It is also known in the art to color or dye various types of unadorned elastic rubber or elasticized cloth strips in order to secure package wrappers.

Despite the foregoing efforts, a need remains for an attractive ribbon apparatus which can be reused, is inexpensive as well as decorative, which resists wear and deterioration, which can readily be used by physically handicapped persons, and which can function to secure wrappers and other items to bundles and packages.

SUMMARY OF THE INVENTION (DISCLOSURE OF THE INVENTION

The invention relates to an apparatus for wrapping or securing packages or bundles. The preferred embodiment is a single continuous ribbon whose two ends are connected by an elastic member, the ribbon and elastic member thus forming a loop of variable circumference. An enveloping sheath is disposed about the elastic member to protect the elastic member and beautify the apparatus. Stretching and contraction of the elastic member, and the attendant motion of the ribbon, occurs within the sheath. In an alternative embodiment, the ribbon is not continuous, but is provided at ends distal from the elastic member with means, such as spring clips, for attaching the ribbon sections to a wrapping material. Secondary identifying or decorative items may be permanently or removably attached to the sheath. A clasp is provided which may be removably disposed upon the sheath or ribbon, and upon which secondary items may be permanently or removably attached.

A primary object of the present invention is to provide a simple and inexpensive means for securing a wrapper around a package.

Another object of the present invention is to provide a means for securing a collection of items into a bundle.

Another object of the present invention is to provide a means for securing a wrapper around a package, a means that is easy to use as well as re-use many times.

A primary advantage of the present invention is that it is easily used by persons who do not have the full use of their hands.

Another advantage of the present invention is that is reusable and promotes environmentally desirable re-use of materials.

Another advantage of the present invention is that it is expandable and adjustable to suit various needs, while its elastic member is protected from wear and photodegradation.

Still another advantage of the present invention is that it allows interchangeable attachment of a variety of items to a wrapped package.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
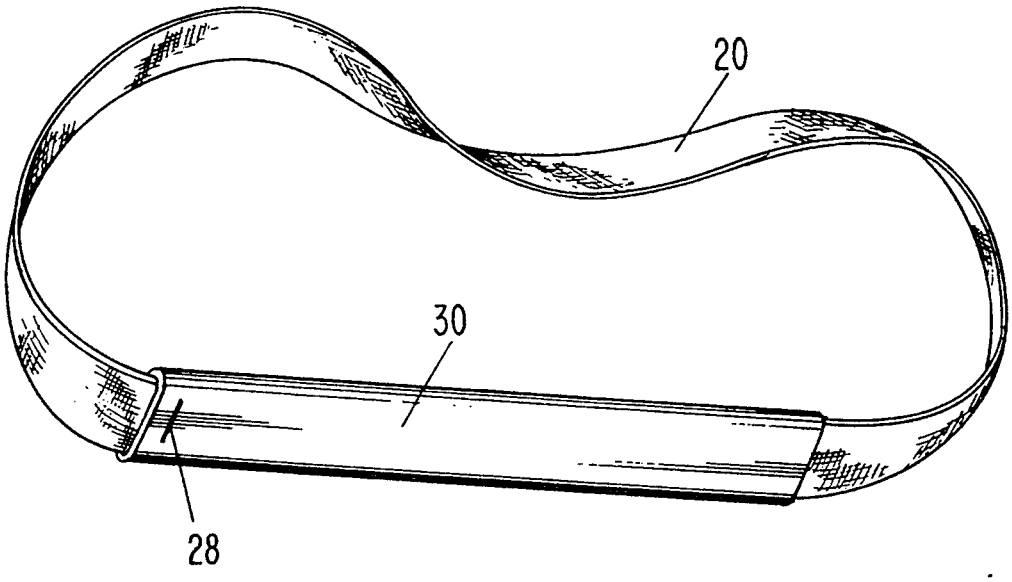
FIG. 1 is a perspective view of a preferred embodiment of the invention.

DESCRIPTION OF THE PREFERRED EMBODIMENT (BEST MODE FOR CARRYING OUT THE INVENTION)

This invention relates to a ribbon apparatus that functions to secure a wrapper and/or other items to a package or bundle. In the preferred embodiment, the apparatus is decorative in appearance, but the invention offers utility in that it is reusable, resistant to wear and deterioration, adaptable to a variety of applications and uses, and is easily used by even the physically handicapped.

Generally described, the apparatus consists of a ribbon whose two ends are connected by an elastic member, with the elastic member contained within and shielded by an enveloping sheath. The ribbon need not be elastic, and preferably consists of conventional fabric ribbon such as is commonly used for ornamental clothing components. The elastic member is a rubber or elastomer band, cord or strip, such that the elastic member and the ribbon together comprise a loop having a variable circumferential length. ("Circumference" will be understood to mean the closed length of the loop, even though the apparatus may be usefully disposed around a non-circular object.) The circumference may be varied by stretching and contracting the elastic member, with the difference between maximum circumference and minimum circumference being defined by the length of the elastic member at fullest extension (maximum circumference) and its unstretched length while at rest (minimum circumference). The elastic member is contained within a sheath-like element, which protects the elastic member, serves as a stiff base for the attachment of secondary items to the apparatus, and improves the overall appearance of the invention.

The invention will find useful application in a variety of contexts. The preferred embodiment of the invention has a primary intended use in the wrapping and decoration of gift packages, such as birthday presents, Christmas gifts, and the like, which are commonly wrapped in paper, cloth, or flexible plastic gift wrap. It will be readily understood, however, that the apparatus of the invention may be usefully employed whenever it is desired to secure cloth or paper wrapping around a package, or to bind items together in a bundle.

The preferred embodiment of the invention is particularly well suited for use by physically handicapped persons, who frequently encounter difficulty unwrapping gifts wrapped by traditional means. More specifically, persons challenged with physical impairments limiting or preventing the use of their hands, e.g. arthritis, amputation, or the like, will find that the invention allows them to unwrap gifts with little or no assistance. Prior art devices normally require the full use of one's fingers to operate scissors or untie knots, or the like, in order to strip a package of its decorative ribbons and wrapping. In contrast, the present device is easily removed with minimum effort and dexterity.

The enveloping sheath element is an important aspect of the invention. It serves to cover the elastic member of the invention, thus protecting it from damaging snags and from photodegradation. It also expands the utility of the invention by allowing the attachment of decorative or functional items to the ribbon apparatus, as shall be further disclosed hereinafter.

Figure 2:
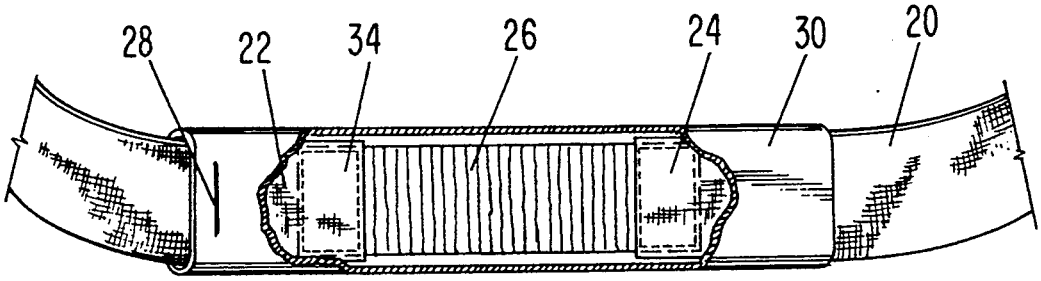
FIG. 2 is a view of a portion of the FIG. 1 embodiment, with a section broken away to reveal certain interior elements.

Reference is made to FIGS. 1 and 2, showing a preferred embodiment of the invention. FIGS. 4–8 and 14 also aid in further conveying an understanding of the preferred embodiment. Ribbon 20 preferably is a ribbon of true woven construction, that is it is weaved from fine cotton, linen, or polyester strands, characterizing the fancy quality of ribbon used in the ornamentation of clothing, tableclothing, and the like- The selection of ribbon material is evident and adaptable to particular uses based on considerations of appearance, durability, and cost. Alternatively, less durable, somewhat cruder, disposable ribbons made from pressed fibers and often used for package wrapping may be employed. The scope of the invention extends to the use of yarn or string for ribbon 20, but the preferred embodiment features a ribbon 20 of fine, durable construction and appealing appearance. In this specification and in the claims, the term "ribbon" shall be understood to mean ribbon, string, yarn, strap, or the like. In gift wrapping applications, ribbon 20 has an ornamental color or pattern (perhaps complimenting or favorably contrasting with the color of the gift wrap).

FIG. 2 illustrates that ribbon 20 has a first end 22 and a second end 24. Ends 22,24 are connected by elastic member 26. Elastic member 26 is secured to each of the respective ribbon ends 22,24 using any satisfactory means of attachment (e.g. stapled, sewn, glued, riveted). Ends 22,24 of ribbon 20 may be reinforced by any suitable means to prevent tearing of ribbon 20 from the tensile forces attributable to elastic member 26 when elastic member 26 is in a stretched condition. With each end of elastic member 26 attached to an end 22 or 24 of ribbon 20, the overall assembly forms a loop whose circumference is adjustable according to the expansion and contraction of elastic member 26.

Elastic member 26 is composed of any substance, e.g. natural or synthetic rubber, elastomers, and the like, that will resume its original shape after being stretched. Conventional "rubber band" loops will suffice, although elastomer strips or straps are preferred. The elastic bands made of flexible, stretchable fabric containing interwoven strands of synthetic rubber, and commonly used in clothing, may also suitably function as an elastic member 26.

Figure 14:
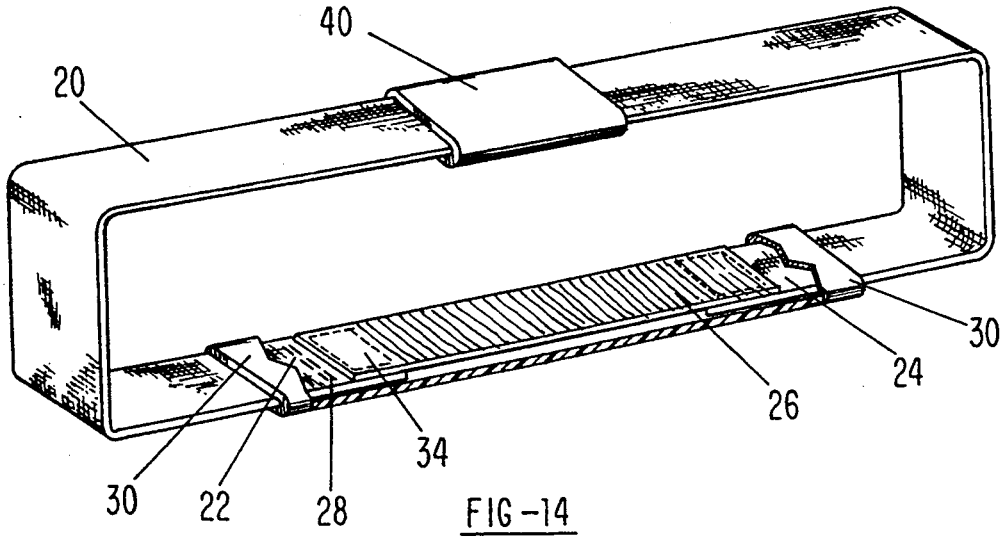
FIG. 14 is another perspective view of the preferred embodiment of the invention, as it may be configured when disposed around a rectangular package, showing a clasp element disposed thereon and with a section broken away to reveal certain interior elements.

With combined reference to FIGS. 1, 2 and 14, it is observed that elastic member 26 is enclosed within sheath 30. Sheath 30 in the preferred embodiment is in the form of a very flattened tube, although it will be apparent that other generally tubular configurations will serve as well. Sheath 30 has a length at least equal to the length of elastic member 26 when elastic member 26 is in a state of maximum extension. The width or diameter of sheath 30 preferably is only slightly greater than the width of elastic member 26.

Sheath 30 preferably, but not necessarily, is composed at least in part of a semi-flexible plastic or other mildly rigid material, such that a degree of stiffness is imparted to the sheath 30. "Stiffness" here or in the claims means resistance to compressive buckling, crinkling, or collapse resulting in a shortening of the effective length of sheath 30 along its longitudinal axis (i.e. in a direction parallel to a line connecting the ends 22,24 of ribbon 20). The sheath 30 preferably is at least sufficiently stiff that when elastic member 26 is stretched to create a contractive force tending to pull ends 22,24 of ribbon 20 towards each other, the frictional forces between ribbon 20 and the interior of sheath 30 are overcome—with the result that ribbon 20 slides within sheath 30, rather than causing the sheath 30 to collapse due to the force imparted by member 26 through friction between ribbon 20 and sheath 30. This characteristic can be imparted to sheath 30 by providing sheath 30 with a smooth plastic liner. In this manner, the buckling, crinkling, and crimping of sheath 30 due to the contractive forces generated by an extended elastic member 26 are minimized or avoided. Sheath 30 thus preferably comprises a material stiffer than the material of the ribbon 20. Some flexibility of sheath 30 in other directions (e.g. perpendicular to its longitudinal axis) is acceptable.

In the preferred embodiment, sheath 30 is securely attached to either one (but not both) of the ends 22,24 of ribbon 20. In the preferred embodiment and as depicted in FIGS. 1, 2 and 14, sheath 30 is attached to first end 22 of ribbon 20 in the same general area where elastic member 26 is attached to first end 22. To enhance the appearance of the apparatus, end 22 is inserted into sheath 30 and there attached, such that the sheath connection 28 of end 22 to sheath 30 and the ribbon connection 34 of elastic member 26 to end 22 are within, and obscured from view by, sheath 30. Thus, ribbon 20 emerges from the interior of sheath 30 in a visually appealing manner.

In the preferred embodiment, second end 24 of ribbon 20 is always contained within sheath 30. Elastic member 26 likewise is entirely enveloped by sheath 30, even when it is maximally extended. First end 22 of ribbon 20 also is within sheath 30. Extension and contraction of elastic member 26 occurs entirely within the interior of the sheath 30, and elastic member 26 is thus always hidden from view within, and protected by the sheath 30.

Figure 3:
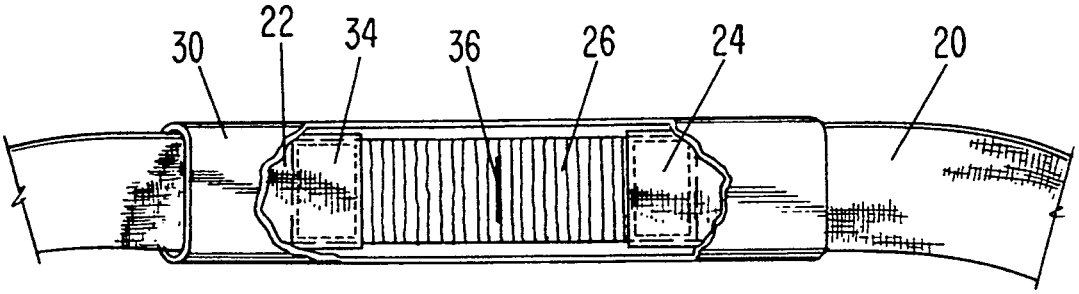
FIG. 3 is a view of an alternative configuration of the embodiment of FIG. 2.
Figure 4:
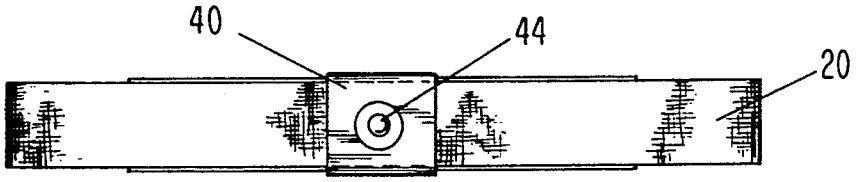
FIG. 4 is a plan view of the preferred embodiment of the invention, showing the clasp element of the invention disposed thereon.
Figure 5:
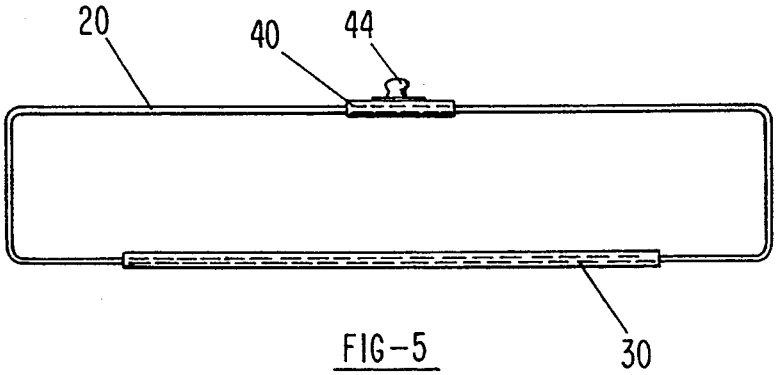
FIG. 5 is a side view of the FIG. 4 embodiment, as it would be configured when disposed around a rectangular package.
Figure 6:
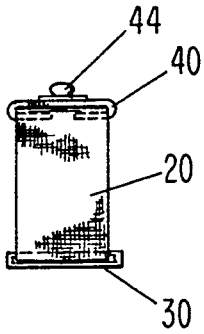
FIG. 6 is an end view of the FIG. 5 embodiment.
Figure 7:
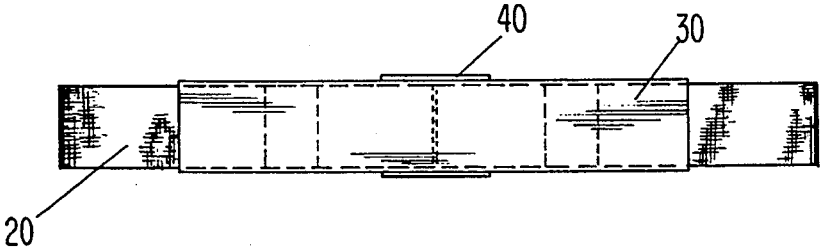
FIG. 7 is a bottom view of the embodiment of FIG. 4.
Figure 8:
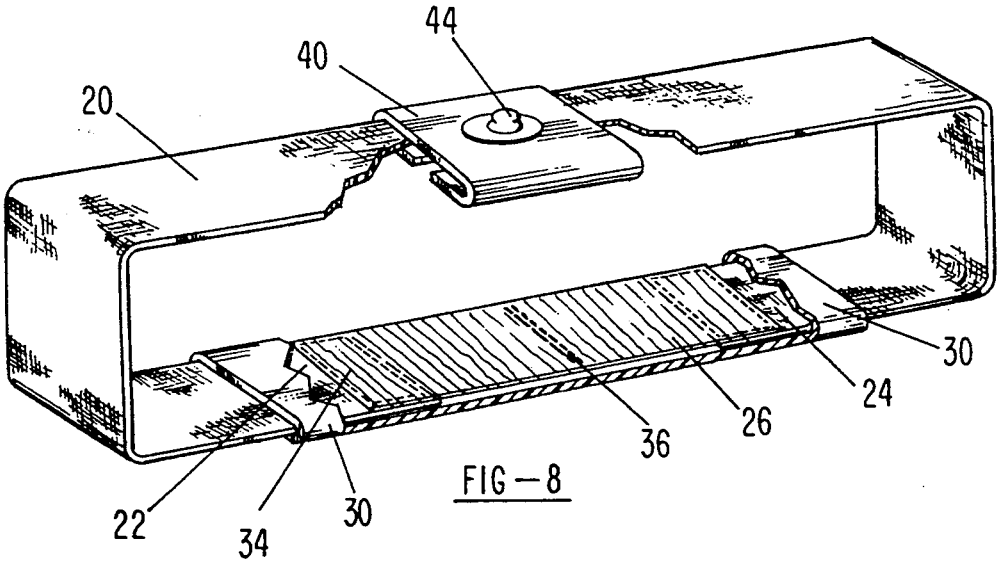
FIG. 8 is a perspective view of the FIG. 4 embodiment, with two sections broken away to show the mode of disposing the clasp element thereon and to reveal certain interior elements.
Figure 9:
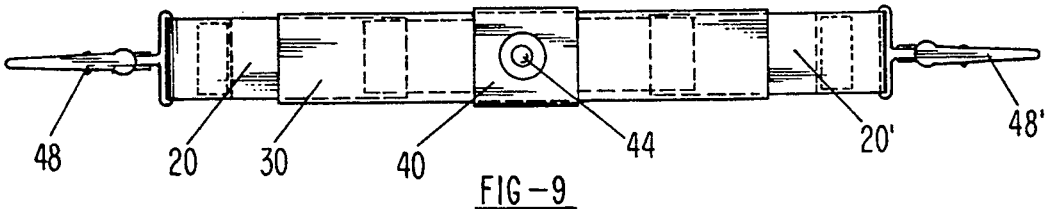
FIG. 9 is a plan view of an alternative embodiment of the invention with the clasp element disposed thereon.
Figure 10:
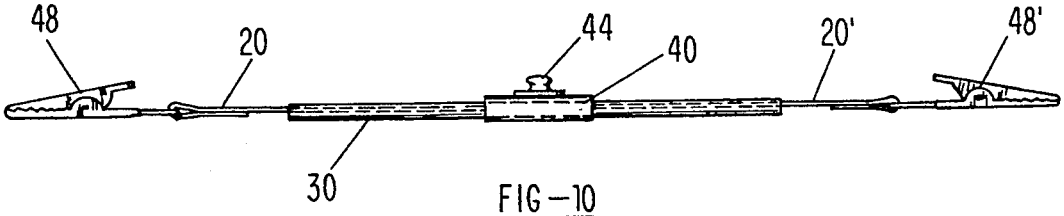
FIG. 10 is a side view of the embodiment of FIG. 9.
Figure 11:
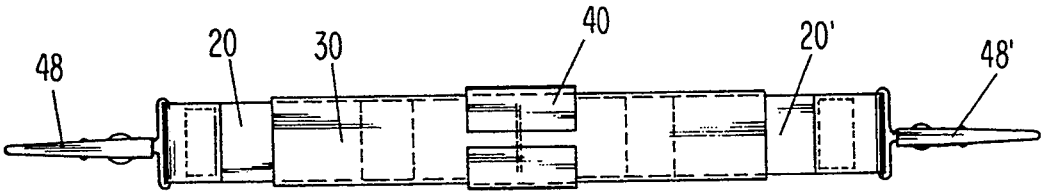
FIG. 11 is a bottom view of the embodiment of FIG. 10.
Figure 12:
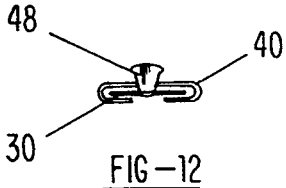
FIG. 12 is an end view of the embodiment of FIG. 10.
Figure 13:
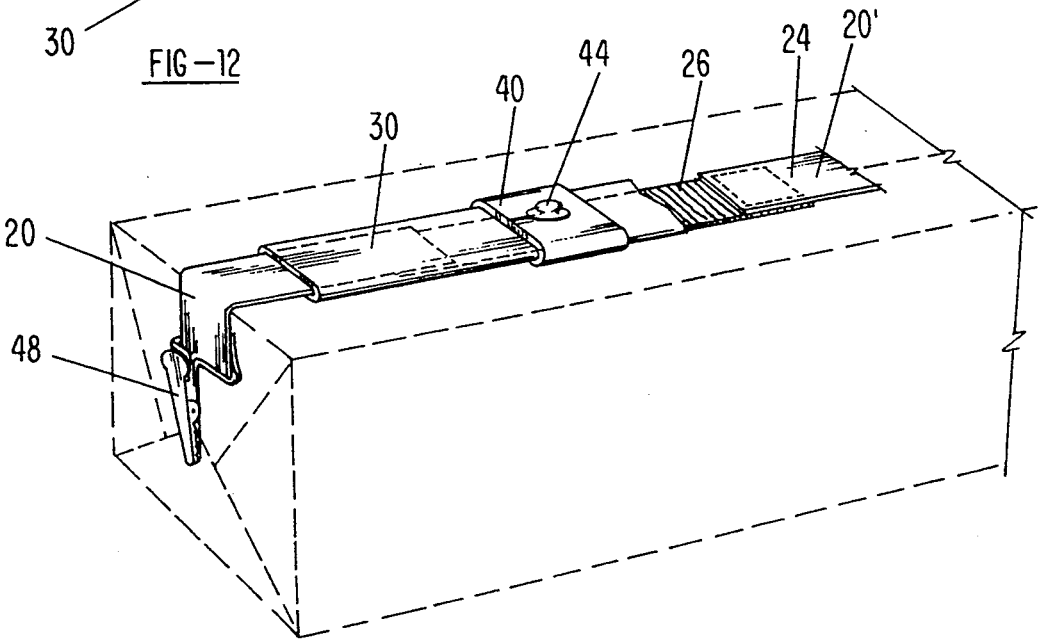
FIG. 13 is a perspective view of a portion of the embodiment of FIG. 9 shown in use upon a wrapped package.

Alternatively, as best shown in FIGS. 3 and 8, elastic member 26 may be attached directly to sheath 30, leaving both ends 22,24 of the ribbon 20 unattached to the sheath 30 and therefore free to glide to and from within sheath 30 as elastic member 26 expands and contracts therein. In this configuration, connection 36 between sheath 30 and elastic member 26 may be anywhere along the length of elastic member 26. In this embodiment, ribbon 20 is free to move in and out of both ends of sheath 30, as opposed to the configuration of FIG. 2 wherein only a single end 24 of the ribbon 20 is slidable within sheath 30. As with the embodiment of FIG. 2, the elastic member 26 and the ends 22,24 of the ribbon 20 are always inside sheath 30, even when elastic member 26 is at maximum extension.

It is observed, therefore, that the expansive/contractive elements of the apparatus are disposed within sheath 30, hidden from view. Any end 22,24 of ribbon 20 that is not attached to sheath 30 is free to slide longitudinally back and forth within the sheath interior. The motion of elastic member 26 as it expands and contracts also freely occurs within the confines of the sheath 30. As elastic member 26 stretches (under forces originating externally of the system of the apparatus) and contracts, ribbon 20 thus slides in and out of one or both ends of sheath 30. Because many commonly available elastic materials are subject to photodegradation under ultraviolet light, and many elastomer/fabric weaves are prone to snags leading to fraying and breakage, sheath 30 offers the notable advantage of protecting the elastic member 26 from destructive abrasive contacts and photodegradation.

Preferably, the exterior of sheath 30 is colored or patterned identically or similarly to the color or appearance of ribbon 20. Accordingly, the assembled apparatus consisting of ribbon 20, elastic member 26, and sheath 30 appears as a uniformly colored loop. To accomplish ideal uniformity of appearance, the exterior of sheath 30 may be covered with woven fabric or ribbon material identical to the composition and color of the ribbon 20 itself.

As shown in FIG. 1, the exterior of sheath 30 offers the user a firm, planar surface upon which a variety of secondary items or information may be permanently or temporarily disposed. Identifying information, such as the contents of the package or the name of the package recipient, may be permanently or removably attached upon the exterior of sheath 30. Also, decorative secondary items such as ribbon bows, ornaments, small trinkets and the like may likewise be attached to sheath 30. Temporary, reusable attachment means, such as hook-and-loop fabric connectors (e.g. VELCRO®), post-and-hole snaps, and magnets, such as those depicted in FIGS. 15–17, may be used to dispose items upon sheath 30, thereby decorating or identifying the package around which the ribbon 20 has been placed. The use of temporary attachment devices that are re-useable (as distinguished from, e.g., cellophane tape) allows the invention to be reused many times. Moreover, temporary attachment elements foster interchangeability, whereby during the course of repeated usages, the invention may bear various different secondary items.

Attention is now invited to FIGS. 4–17, which collectively illustrate an optional feature of the preferred embodiment of the invention. FIGS. 4-8 and 14 show ribbon 20, together with elastic member 26 and sheath 30, as configured when placed around a box or package (not shown) with a rectangular profile. The optional element featured in these figures is clasp 40. Clasp 40, as best illustrated in FIGS. 8, 11 and 12, and FIGS. 15–17, preferably is a rigid unit having a generally planar spine with two recurvate prongs extending therefrom. Thus, as depicted in FIGS. 12 and 15–17, clasp 40 has a C-shaped cross section, with a small gap of uniform width separating the free ends of the recurvate prongs.

Clasp 40 is made of any rigid or mostly inflexible material, such as plastic or metal. Clasp 40 is dimensioned so as to slip over and snugly around ribbon 20, as shown in FIGS. 4–8 and 14, or, alternatively, around sheath 30 as shown in FIGS. 9–13. The ribbon 20 or sheath 30 is simply slipped through the gap between the recurvant prongs of the clasp 40, and the clasp 40 is situated with its planar spine facing outward away from the package, as depicted and suggested in the drawings. When properly positioned upon ribbon 20 or sheath 30, clasp 40 can be easily moved only longitudinally along ribbon 20 or sheath 30. So configured and disposed, clasp 40 serves as an alternative or additional base upon which various secondary items such as name tags, small cards, ribbons, bows, and the like, may be either permanently or temporarily attached. Despite being permanently attached to a clasp 40, secondary items may be reused and interchanged among various ribbons (and their corresponding packages) by the simple expedient of removing clasp 40 from one ribbon and slipping it onto another.

Figure 15:
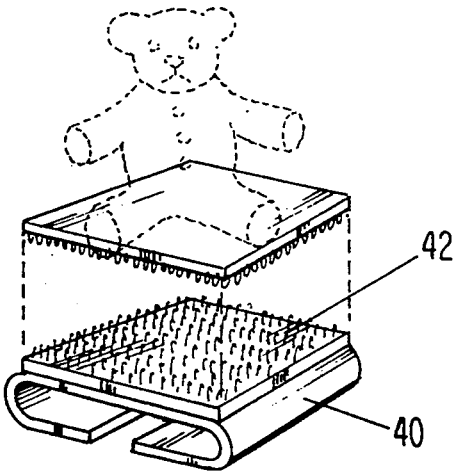
FIG. 15 is a perspective view of a temporary attachment element of an alternative embodiment of the invention.
Figure 16:
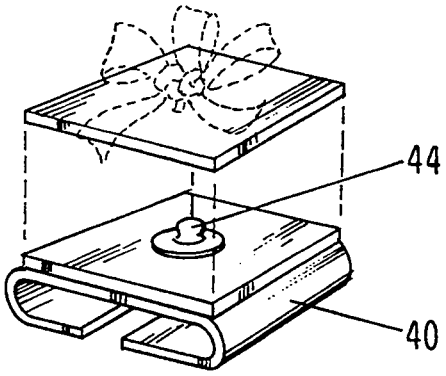
FIG. 16 is a perspective view of an alternative temporary attachment element of an alternative embodiment of the invention.
Figure 17:
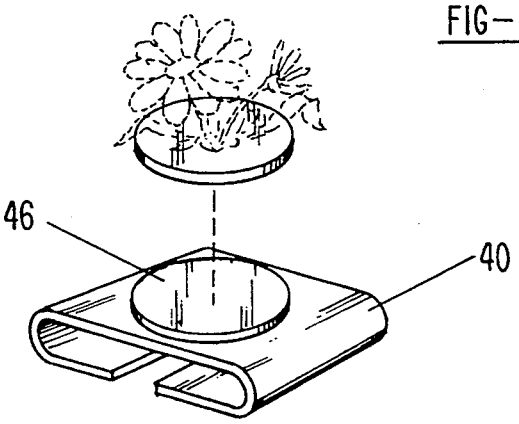
FIG. 17 is a perspective view of an alternative temporary attachment element of an alternative embodiment of the invention.

FIG. 14 depicts a clasp 40 properly positioned upon ribbon 20. (It is noted that more than one clasp 40 may be used on a single ribbon.) FIGS. 15–17 illustrate various potential means for removably attaching secondary items such as small toys, bows, decorations, novelties and the like, to clasp 40. Such temporary attachment means include, by way of non-limiting example, hook-and-loop fabric connector 42 (VELCRO ®) (FIG. 15), snap connector 44 (FIG. 16), and magnetic connector 46 (FIG. 17).

FIGS. 9–13 illustrate an alternative embodiment of the invention. This alternative embodiment incorporates a ribbon 20 that is not looped, but rather comprises two ribbon sections 20,20' whose proximal ends are connected by an elastic member 26 within sheath 30. A snap connector 44 disposed upon a clasp 40 is shown positioned upon the sheath 30 to illustrate the clasp feature of the invention. At the distal ends of ribbon sections 20,20' are means for temporarily connecting the distal ends of the sections 20,20' to the wrapping material (dotted lines in FIG. 13) surrounding the package or bundle. The preferable means for connecting the apparatus to the wrapping material are spring-loaded spring clips, such as alligator clips 48,48', although equivalent alternatives to such clips will suffice. This embodiment of the apparatus of the invention thus connects directly to the wrapping material, and the contractive force from elastic member 26 assists in holding the wrapping material tightly in place.

Uses of the apparatus are suggested by its foregoing description. Any package or bundle to be wrapped is first wrapped in paper, cloth or plastic wrapping; the apparatus of the invention is then slipped into place over the wrap and around the package in order to hold the wrap in place. The adjustable length of the loop of the apparatus allows the loop to be stretched over and around the package, and the elastic character of elastic member 26 causes the apparatus to contract snugly (e.g. ends 22,24 of ribbon 20 are drawn towards each other by elastic member 26) to fit the perimeter of the wrapped box and hold the wrap in place. Alternatively, an alternative embodiment incorporating temporary connecting means such as alligator clips (FIG. 13) may be stretched into place and temporarily secured to the wrap. If desired, secondary items may be permanently or temporarily attached to sheath 30. If desired, one or more clasps 40 may be slipped around ribbon 20 or sheath 30, to serve as the foundation upon which secondary items may be temporarily or permanently attached.

Of course, the apparatus of the invention alternatively may simply be disposed about a collection of items, such that the contractive effect of elastic member 26 causes the items to be held together in a manageable bundle.

An advantage of the preferred embodiment of the invention is its ease of removal from the package. A small child or physically impaired person can slip the apparatus off the package and unwrap the package with ease, without tools or even the use of fingers.

The elastic character of any single apparatus of the invention offers the advantage of dimensional flexibility of the packages to be secured—allowing the invention's use on a variety of package sizes. It is contemplated, however, that the unstretched circumference or length of the apparatus of the invention may be customized to correspond to standardized gift and packaging box sizes encountered in the industry.

It is also contemplated that the apparatus of the invention will be re-useable, rather than disposable. Because it is durable and adjustable to fit packages of different sizes, it can be used repeatedly and interchangeably. Similarly, exploitation of the clasp 40 feature of the invention, and/or the use of temporary attachment means 42,44,46, promotes economical re-use and interchangeable use of secondary items such as bows, name tags, decorative toys, novelties, and the like, from time to time and between package recipients.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, patents, and publications cited above are hereby incorporated by reference.

What is claimed is:

1. An apparatus for wrapping packages comprising:
a ribbon comprising a first end and a second end;
elastic means for connecting said first ribbon end to said second ribbon end; and
a generally tubular flexible sheath, completely enveloping said elastic connecting means, wherein said sheath comprises an opaque material stiffer than a material of said ribbon.

2. The apparatus of claim 1 wherein said means for connecting comprises an elastic member, said member comprising at least one material selected from the group consisting of natural rubbers, synthetic rubbers, and elastomers.

3. The apparatus of claim 2 wherein said means for connecting comprises a flat band.

4. The apparatus of claim 2 wherein said means for connecting comprises a strip woven from elastic and inelastic strands.

5. The apparatus of claim 1 wherein said tubular sheath comprises a flattened tube.

6. The apparatus of claim 1 wherein said means for enveloping is attached to said first end of said ribbon.

7. The apparatus of claim 1 wherein said means for enveloping is attached to said elastic means for connecting.

8. The apparatus of claim 1 further comprising means for removably disposing secondary items upon said ribbon, wherein said means for removably disposing is removably attached to said ribbon.

9. The apparatus of claim 8 wherein said means for removably disposing comprises at least one clasp.

10. The apparatus of claim 1 further comprising means for temporarily connecting said ribbon to a wrapping material.

11. The apparatus of claim 10 wherein said means for temporarily connecting comprises at least one spring clip.

12. An apparatus for wrapping packages comprising:
a ribbon comprising a first end and a second end;
elastic means for connecting said first ribbon end to said second ribbon end;
sheath means for enveloping said elastic connecting means; and
means for removably attaching secondary times to said means for enveloping.

13. The apparatus of claim 12 wherein said means for removably attaching comprises a member selected from the group consisting of magnets, hook-and-loop fabric fasteners, and post-and-hole snap fasteners.

14. An apparatus for wrapping packages comprising:
a ribbon comprising a first end and a second end;
elastic means for connecting said first ribbon end to said second ribbon end;
sheath means for enveloping said elastic connecting means;
at least one clasp means for removably disposing secondary items upon said ribbon; and
means for removably attaching secondary items to at least one said clasp.

15. The apparatus of claim 14 wherein said means for removably attaching comprises a member selected from the group consisting of magnets, hook-and-loop fabric fasteners, and post-and-hole snap fasteners.

16. An apparatus for securing packages or bundles, said apparatus comprising:
an elastic member;
a ribbon, comprising a first end and a second end;
a generally tubular sheath surrounding said elastic member, wherein said sheath comprises an opaque material stiffer than a material of said ribbon; and
wherein said first end and said second end of said ribbon are attached to said elastic member and at least one said end is slidably disposed within said sheath.

17. An apparatus for securing packages or bundles, said apparatus comprising:
an elastic member;
a ribbon, comprising a first end and a second end;
a generally tubular sheath surrounding said elastic member, wherein said sheath comprises an opaque material stiffer than a material of said ribbon;
wherein said first end and said second end of said ribbon are attached to said elastic member and at least one said end is slidably disposed within said sheath; and
means for removably disposing secondary items upon said ribbon, wherein said means for removably disposing is removably attached to said ribbon.

18. An apparatus for wrapping packages comprising:
a ribbon comprising a first end and a second end;
an elastic member connecting said first ribbon end to said second ribbon end, whereby said elastic member and said ribbon comprise a permanently closed loop;
a sheath disposed completely around said elastic member;
at least one clasp slidably disposed upon said ribbon; and
means for removably attaching secondary items upon said clasp.

* * * * *